US005391829A

United States Patent [19]

Hasebe et al.

[11] Patent Number: 5,391,829

[45] Date of Patent: Feb. 21, 1995

[54] ELECTRONIC MUSICAL INSTRUMENT WITH AN AUTOMATED PERFORMANCE FUNCTION

[75] Inventors: Masahiko Hasebe; Yaushi Kurakake, both of Hamamatsu, Japan

[73] Assignee: Yamaha Corporation, Hamamatsu, Japan

[21] Appl. No.: 996,703

[22] Filed: Dec. 24, 1992

[30] Foreign Application Priority Data

Dec. 26, 1991 [JP] Japan ..... 3-344917

[51] Int. Cl.[6] ..... G10H 1/06; G10H 1/42; G10H 1/46

[52] U.S. Cl. ..... 84/622; 84/633; 84/635; 84/659; 84/665; 84/667; 84/DIG. 12

[58] Field of Search ..... 84/609-614, 84/622-625, 633-638, 649-652, 659-661, 665-669, DIG. 12

[56] References Cited

U.S. PATENT DOCUMENTS 5,185,492 2/1993 Ikeya ..... 84/633

FOREIGN PATENT DOCUMENTS 63-264796 10/1985 Japan .
63-264795 11/1988 Japan .
1-309098 12/1989 Japan .

*Primary Examiner*—Stanley J. Witkowski
*Attorney, Agent, or Firm*—Spensley Horn Jubas & Lubitz

[57] ABSTRACT

An electronic musical instrument with an automatic performance function includes manual performance device, an automatic performance device and a control. The manual performance device, having a plurality of performance manipulators to be performed by a player, generates a manual performance musical tone having a tone color in response to the player's performing. The automatic performance device automatically generates automatic performance musical tones of a plurality of parts respectively corresponding to a plurality of tone colors. The control, in response to generation of the manual performance musical tone.

16 Claims, 9 Drawing Sheets

ELECTRONIC MUSICAL INSTRUMENT WITH AN AUTOMATED PERFORMANCE FUNCTION

BACKGROUND OF THE INVENTION

1. Field of the Invention

The present invention relates to an electronic musical instrument provided with an automatic performance function.

2. Description of the Prior Art

Electronic musical instruments, having an automatic performance function in addition to an manual performance function, have been in practical use. In the manual performance function, a manual performance tone is generated in response to a player's performance. In the automatic performance function, an automatic performance tone is automatically generated by reading prestored data according to a tempo clock. This kind of electronic musical instruments generally stores automatic performance data of a plurality of parts and can simultaneously generate automatic performance tones respectively corresponding to the plurality of parts by reading the data simultaneously. The Japanese Patent Laid-open publication Nos. sho 63-264796 and sho 63-264795 each discloses one of this kind of electronic musical instruments.

In the above disclosed electronic musical instrument, manual performance causes all of or a predetermined part of the automatic performance tones of the automatic rhythm performance not to generate for a predetermined period. Therefore, even though only one performance manipulator (e.g., snare drum) is manipulated and thereby only one manual performance tone is generated, all or most of the automatic performance tones don't generate, so that the number of rhythm tones becomes few resulting boring a performer.

SUMMARY OF THE INVENTION

It is, therefore, an object of the present invention to provide an electronic musical instrument with an automatic performance function in which, in response to generation of the manual performance musical tone, generation of an automatic performance musical tone corresponding to the manual performance musical tone is automatically stopped for a predetermined period so that an ad-lib play (manual performance function) is inserting for a player.

In accordance with the present invention, an electronic musical instrument comprises manual performance means, provided with a plurality of performance manipulators to be performed by a player, for generating a manual performance musical tone having a tone color, in response to the player's performing, automatic performance means for automatically generating automatic performance musical tones of a plurality of parts respectively corresponding to a plurality of tone colors, and control means responsive to generation of the manual performance musical tone, for stopping generation of an automatic performance musical tone, from among the automatic performance musical tones, of a part corresponding to the tone color of the manual performance musical tone to be generated by the manual performance means, and after a predetermined period, for proceeding with the generation of the automatic performance musical tone.

In the present invention, only an automatic performance tone having the tone color corresponding to the tone color of a performance manipulator, which is manipulated manually by a player, is released from the tone generation, so that even though only one performance manipulator is manipulated, the tone generation doesn't result in boring automatic rhythm generation. The present invention can make the player part-replace-feeling that the manual performing is replaced with one or more parts in the automatic rhythm performing.

DETAILED DESCRIPTION OF THE PREFERRED EMBODIMENT

Figure 1:
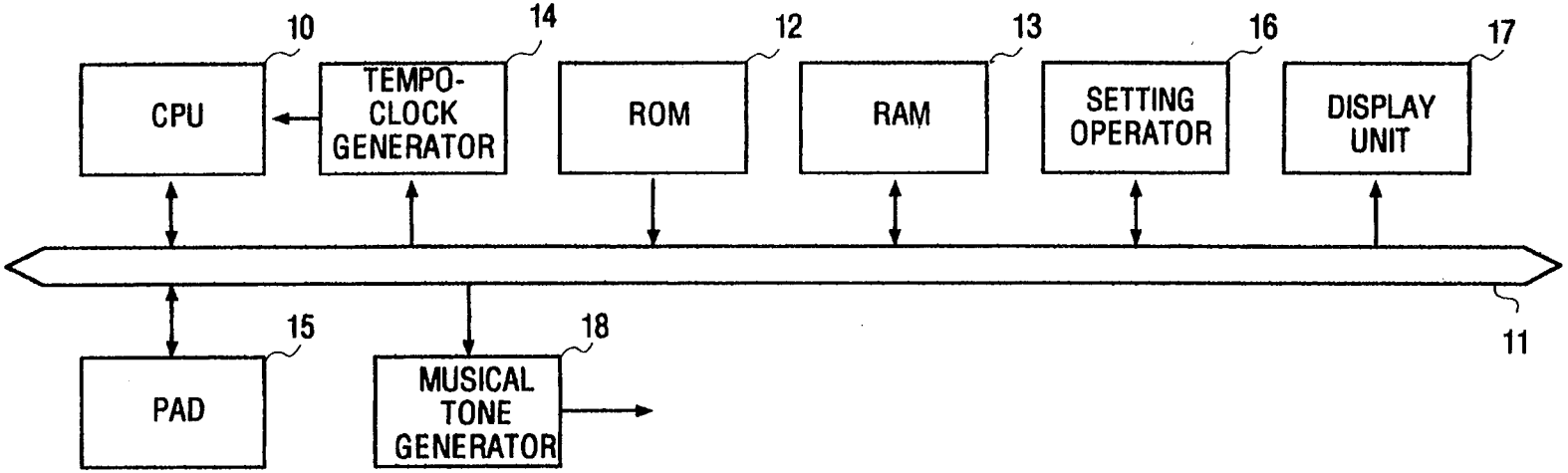
FIG. 1 is a block diagram of an electronic musical instrument embodying the present invention.

FIG. 1 is a block diagram of an electronic musical instrument (rhythm machine) which embodies the present invention. This rhythm machine is controlled by a CPU 10. A ROM 12, a RAM 13, a tempo clock generator 14, a playing pad 15, a setting performance manipulation element 16, a display unit 17 and a tone generating part 18 are connected to the CPU 10 through a bus 11. An operation control program of this instrument and tone color data are stored in the ROM 12, and various registers for control are set in the RAM 13. The tempo clock generator 14 is an oscillator that generates a clock pulse with a cycle specified by the CPU 10. This clock pulse is inputted to the interrupt terminal of the CPU 10. The CPU 10 executes the automatic musical playing according to this clock pulse. The playing pad 15 is equipped with pads 21 to 24.

Distinct tone colors are allocated respectively to pads 21 to 24 with various combinations.

The set of setting performance manipulation element 16 includes a ten-key 20, a tempo switch 26 (26*a*, 26*b*), a mode set switch 27, a minus-one mode switch 29 and a start/stop switch 31. A display unit 17 includes a 2-rowed, 7-segmented display 25 and led indicators 28 and 30 in FIG. 2. A musical tone generator 18 has a plurality of tone generating channels and generates a specified musical tone signal based on the tone color data and the musical playing data inputted from the CPU 10.

Figure 2:
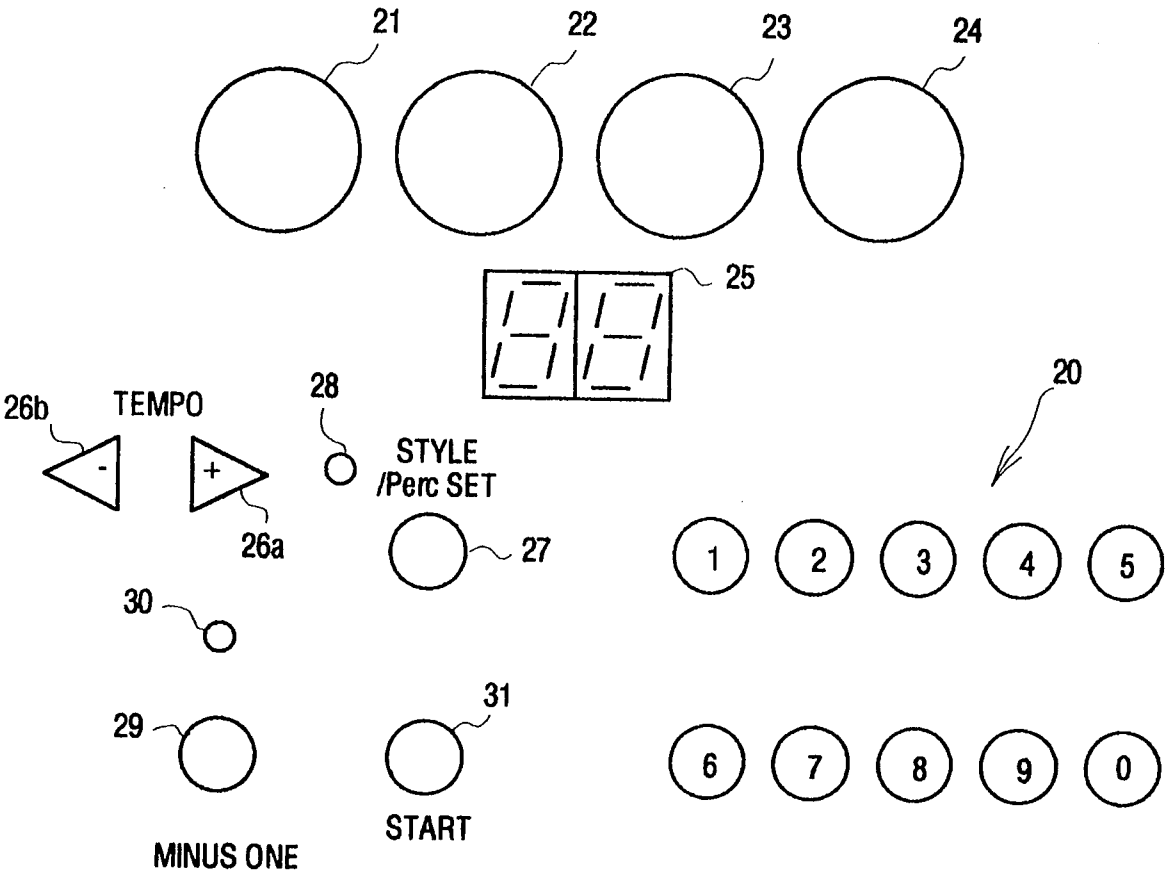
FIG. 2 is a schematic operation panel of the electronic musical instrument.

FIG. 2 is a schematic arrangement of a control panel. Pads 21 to 24 are made as large as a player can beat them with fingers or palms and arranged horizontally in one line. The ten-key 20 is used to select combinations of tone colors, rhythm styles and the like. The tempo switch 26 (26*a* and 26*b*) are switches to set a tempo for the automatic playing. When the switch 26*a* is turned on, the tempo of a music becomes faster by a fixed value, and when the switch 26*b* is turned on, the tempo becomes slower by the fixed value. The mode set switch 27 is a switch to shift a mode of a number inputted from the ten-key 20 between a rhythm style number and a percussion set number. The minus-one mode switch 29 is a switch to set/release the minus-one mode which makes a specified part off while the mode is automatic playing. In case one of the pads 21 to 24 is turned on in the minus-one mode, the part of the tone color assigned to the pad is not generated for a fixed period of time (four bars including the bar in which the pad is turned on). The start/stop switch 31 is a switch to turn the automatic playing mode on/off. In a general mode, turning the switch 31 on results in a start of the automatic musical playing. If the switch 31 is turned on in the automatic playing mode, the playing will stop at the first bar after being switched on.

Figure 3:
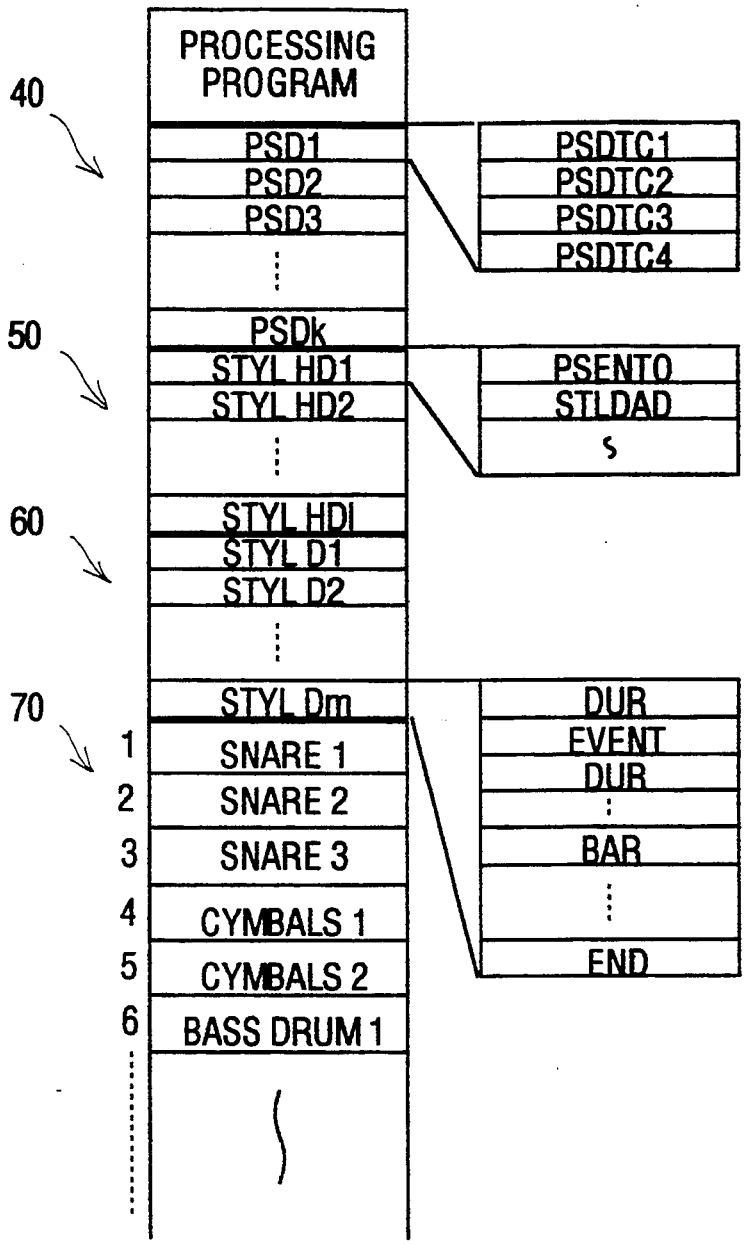
FIGS. 3 and 4 show parts of a memory in the electronic musical instrument.

FIG. 3 shows a part configuration of the ROM 12. An area 40 is a percussion set data storage area. Percussion set data PSDN (N=1~k) consists of four tone color numbers which are assigned to pads 21 to 24. A tone color number is data to represent one of the plurality of the tone color numbers stored in an area 70. An area 60 is a style data storage area. Style data STYLDN (N=1~m) are respectively automatic musical playing data for the plurality of parts. These automatic musical playing data consist of event data EVENT, duration data DUR, bar line data BAR and end data END. All the event data are tone generation event data, i.e., since a musical tone of a percussion will naturally be released, no musical-tone-release event data is required. The event data consists of a code which represents the data is a musical-tone-generation event and data of its own tone color. Since each event data is distinguished by its tone color data, a plurality of parts can be stored in a track. An area 50 is a style header storage area. A style header STYLHDN (N=1~l) is data which is loaded when a specified style (rhythm style: rock, bossa nova, or the like) is selected. This data consists of the head address STDAD of a style data STYLD which is automatic musical playing data of the style to be loaded and percussion set data PSETNO which is the optimum for the style. The percussion set which is stored in the percussion set data PSETNO is compulsively selected in the minus-one mode in place of the manually set data. The area 70 is, as mentioned above, the tone color data storage area. The tone color data of a plurality of tone colors of percussions are stored in this area.

Each tone color is distinguished by a tone color number. In generating a musical tone, this tone color data is sent to a TONE GENERATOR 18 to form a tone wave.

Figure 4:
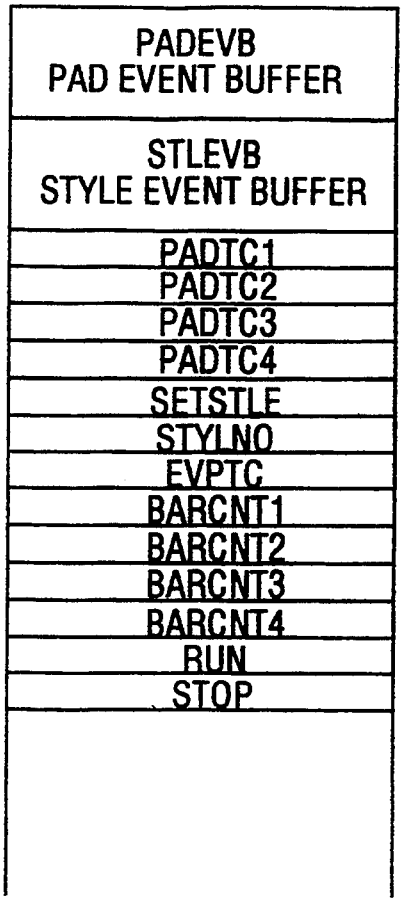

FIG. 4 shows registers set in the RAM 13. The function of each resister will be described later together with the description of its operation.

FIGS. 5 to 11 are flowcharts showing the process of the present electronic musical instrument.

Figure 5:
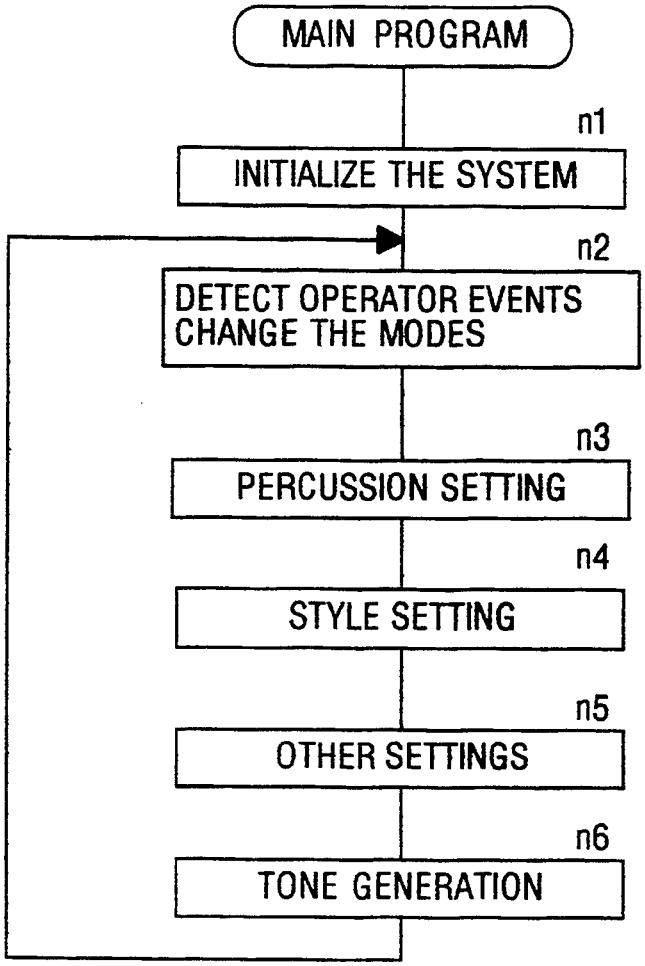
FIGS. 5 to 9 are flow charts showing a process of the electronic musical instrument.

FIG. 5 is a flowchart showing the main routine. When a power switch is switched on, the system is initialized (n1). After the initialization, a detection process of a switch event, a mode change process (n2), a percussion setting process (n3), a style setting process (n4), other setting processes (n5) and a musical tone generation process (n6) are successively performed. The detection of the switch event is an operation for detecting whether any pad or any panel switch is operated or not and for writing the result of the detection in a pad event buffer PADEVB and a style event buffer STLEVB. The mode change process is a process to change the mode according to an on-operation of a mode set switch 27 or a minus-one switch 29, which are included in the panel switches, and to make the corresponding LED 28 or 30 blink on or off. The mode of the electronic musical instrument is changed by the mode change switch. Other setting processes (n5) include a tempo setting operation and the like.

Figure 6:
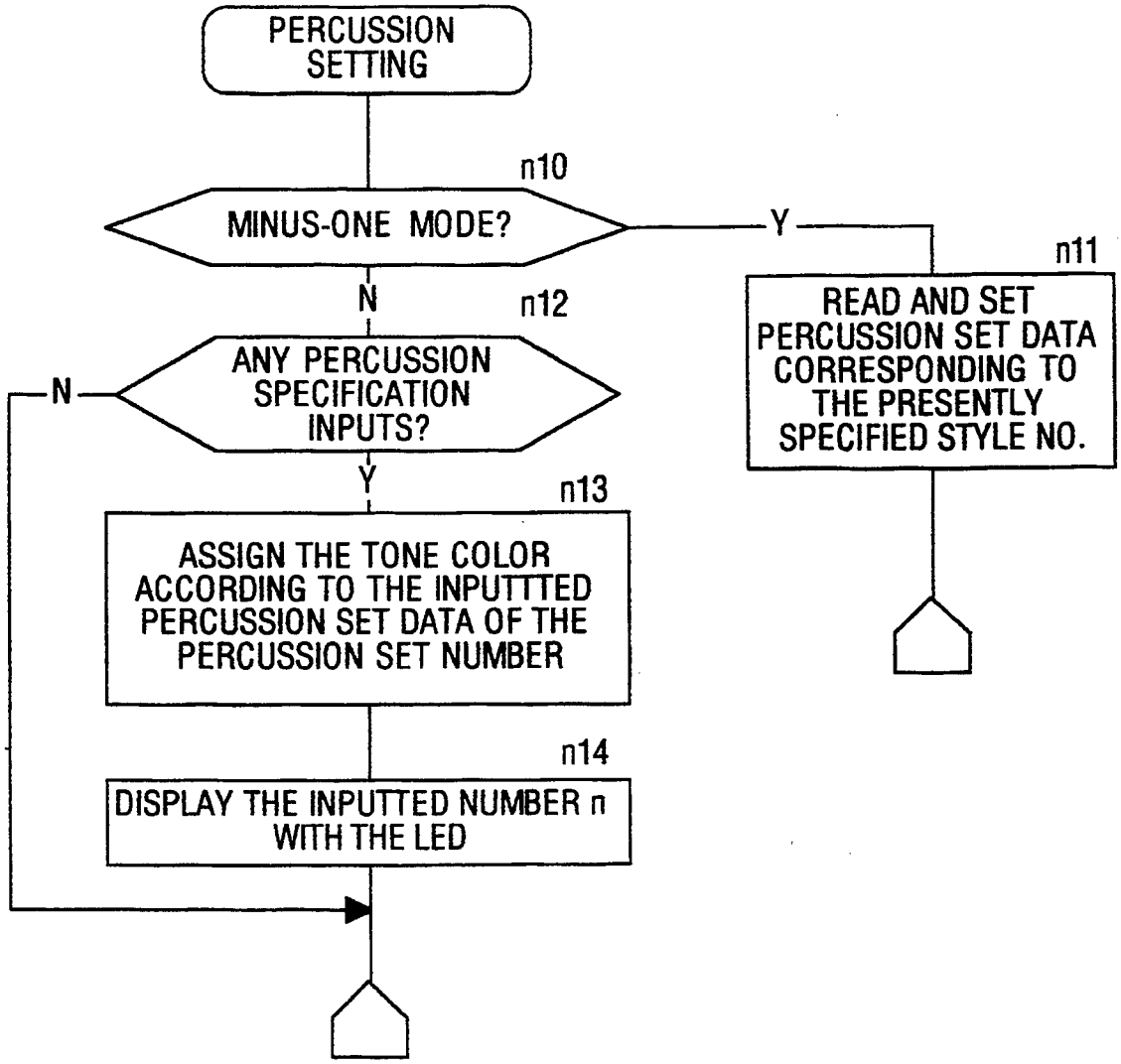

FIG. 6 is a flowchart showing the percussion setting process. This process works only when the mode is the percussion setting mode. First, it is judged whether the mode is minus-one or not (n10). In case the mode is the minus-one mode, a percussion set corresponding to the rhythm style being designated is compulsively selected. Therefore, PSDTC 1 to 4 of the percussion set data PSDS are set in the tone color number registers PADTC 1 to 4 for the pad, referring to a style header STYLHn (n is the designated style number) (n11). While in case the mode is not minus-one, it is judged whether there is a percussion set designation input or not (n12). If there is no designatory input, the process returns without doing anything else. If there is a designatory input, percussion set data PSDn corresponding to the percussion set number n inputted through the ten-key is read and the tone color data in the percussion set data is assigned to each pad (PADTC 1 to 4) (n13). A set number n inputted is displayed on a 7 SEGMENT DISPLAY 25 (n14) and the process returns.

Figure 7:
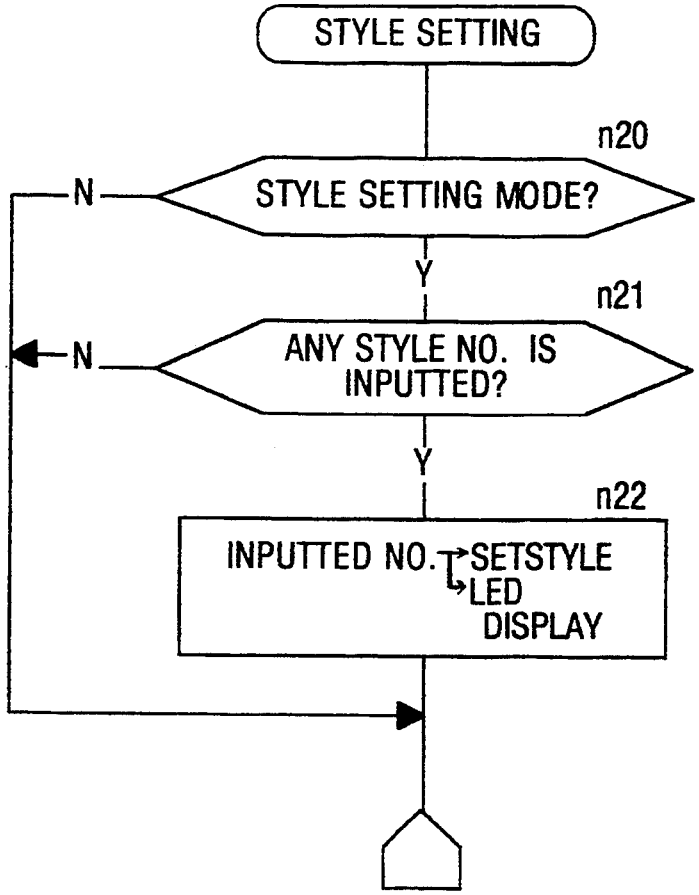

FIG. 7 is a flowchart showing the style setting process. In n20, it is judged whether the mode is the style setting mode or not(n20). In case of the style setting mode, it is judged whether there is any input data through the ten-key (input of a style number) or not (n21). If there is an input of a style number(n21), the inputted style number is set in the SETSTYLE REGISTER and the number is indicated with the LED (n22).

Figure 8:
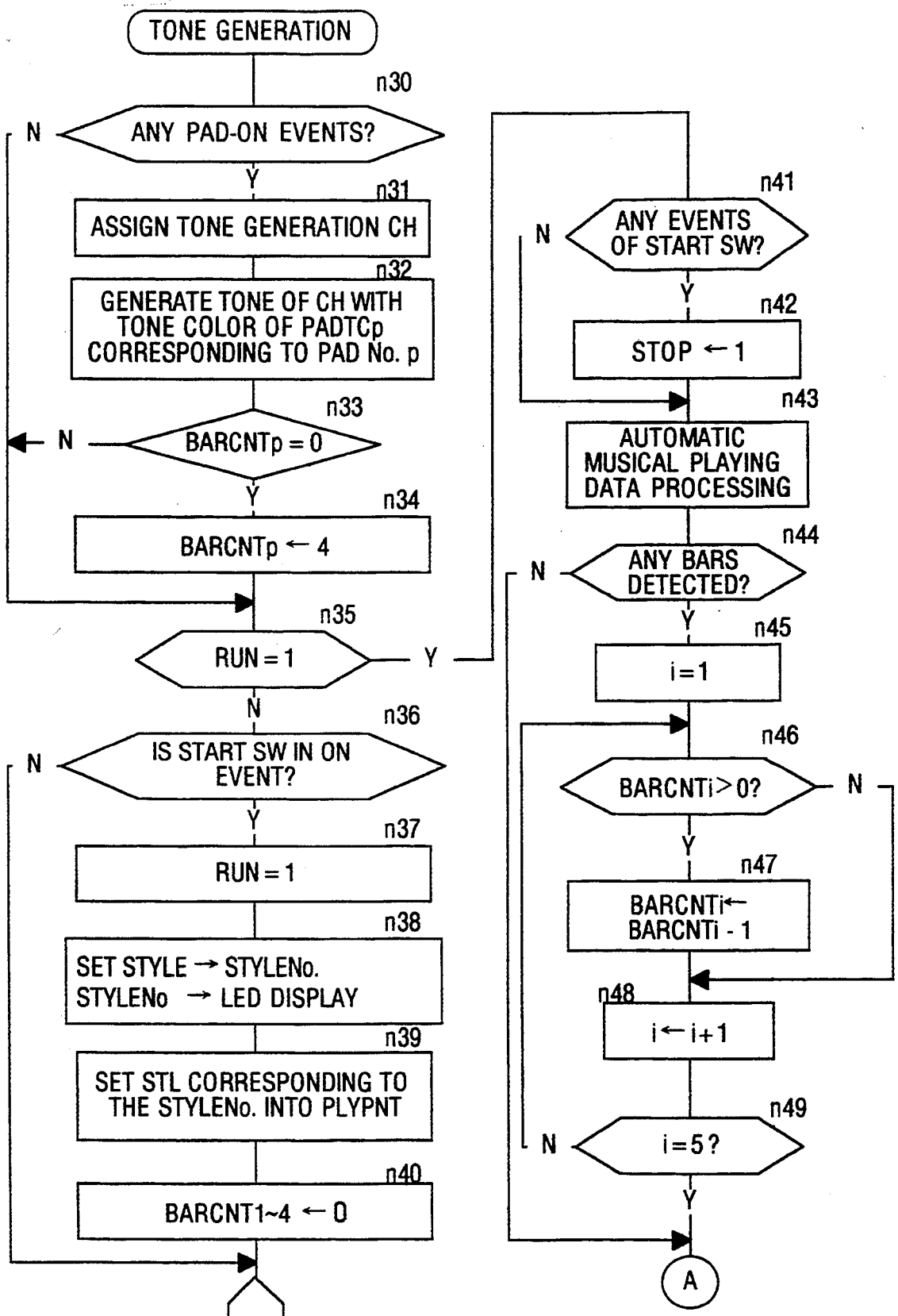
Figure 9:
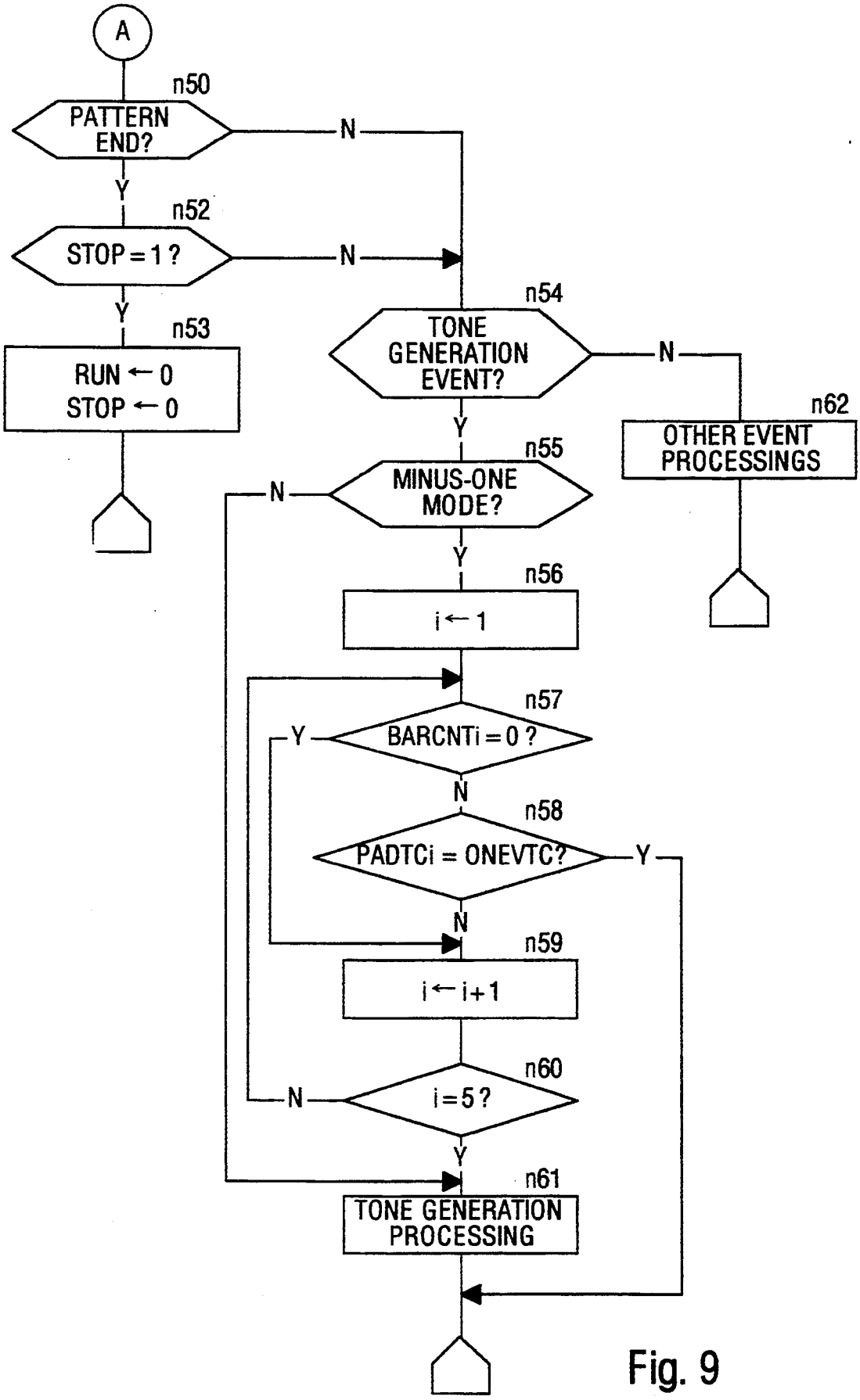

FIGS. 8 and 9 are flowcharts showing the musical tone generation process. In this process, a rhythm tone is generated based on the automatic musical playing data and the pad-on data. In this case, if the present mode is the minus-one mode, the generation of the part (tone color) of the minus-one by the automatic musical playing is suspended for four bars from the first pad-on timing This enables the player to insert an ad-lib play in the section.

At first, it is judged whether there is a pad-on event(n30). If there is no event, the process proceeds to n35. If there is a pad-on event, the musical tone generation channel to generate a musical tone corresponding to the pad-on event is assigned(n3) and the musical tone with the tone color of PADTCp corresponding to the pad number p is generated(n32). Then it is judged whether a bar counter BARCNTp which counts off-time (tone release time) indicates 0 or not (n33). If the counter indicates 0, in order not to generate any musical tone of this part for four bars, 4 is set in the BARCNTp (n34). If the BARCNTp doesn't indicate 0, the process forwards to n35 because it means this part is off at the present. Still, the BARCNT is reduced by 1 in n47 as it is explained afterwards.

In n35, it is judged whether a RUN indicates 1 or not (n35). If the RUN does not indicate 1 (indicate 0), as it means the instrument is not playing music automatically, the steps of n36 to n40 are performed. If the RUN indicates 1, as the instrument is playing music automatically, n41 to n62 are performed.

In case the RUN indicates 0, it is judged whether there is an on-event of the start/stop switch 31 (n36). If there is an on-event, the RUN is set to 1 (n37), the style number SETSTYLE being presently designated is set in STYLENO and displayed with the LED (n38). The head address STLDAD of the automatic musical playing data corresponding to this style number is set in a PLYPNT (n39). Then counters BARCNT1 to 4 for part-off are cleared (n40) and the process returns.

In case the RUN indicates 1, it is judged whether there is an on-event of the start/stop switch 31(n41). If there is an on-event, to stop the automatic musical playing, a STOP PLUG is set to 1 (n42), and the process forwards to n43. In the other cases, the process proceeds from n41 directly to n43. At n43, the musical playing data corresponding to the present timing is read from the automatic musical playing data (style data: STYLD). In this operation of reading, if the read data is musical tone generation event data, the tone color data is set in ONEVTC.

In case the read musical playing data is bar data (n44), n44 to n49 are carried out. BARCNTi (i=pad numbers:1 to 4) which does not indicate 0 is reduced the count by 1 (n44 to n49). While the BARCNTi indicate the number larger than 0, the part(s) corresponding to the tone color of the pad(s) is/are kept off. The duration of it is four bars including the bar in which the pad is turned on for the first time (see n34).

If the musical playing data read is END data and the STOP indicates 1, to stop the playing, the RUN and STOP are set to 0 (n53) and the process returns.

If the musical tone generation event data is read, it is judged whether the present mode is the minus-one mode or not (n55). If the mode is not the minus-one mode, the process forwards to n61 and the musical tone generation process is performed. If the mode is the minus-one mode, it is judged whether the tone color ONEVTC to be generated in the automatic musical playing is that of the part which is off at the moment or not (n56 to 60). If the tone color is not of the part being off, the generation process(n61) is operated. If the tone color is of the off-part, the musical tone generation process is skipped and the process returns.

In case of the events other than the above (e.g., the program transfer event), the corresponding processing is operated and the process returns.

By the operations of the above, the automatic musical playing with the tone color generated by the pad-on is turned off for four bars thereafter.

Yet, the duration for which the part is kept off is not necessarily four bars. It can be decided according to a tempo, time, or the like. It also can be programmed by the player beforehand or can be changed according to a touch of the play on the pad or a performance style.

Not only the tone color generated by a pad-on but a plurality of tone colors similar to it or pre-set tone colors can be off, and besides, all the parts can be turned off. These correspondences to tone colors are optionally programmable.

It is also possible to reduce the volume of the tone color of the part to be off instead of not generating the tone color to be off at all. Moreover, when the part is off or it is resumed, the tone volume control manner like a fade-in/out can be used.

Though correspondences to the rhythm styles and the percussion sets are set in the style header STYLHD beforehand, they can be also programmable by the user.

In the present embodiment, the pad performance-manipulation-element is made to have priority during the playing by automatic musical playing and the pad performance-manipulation-element, this method can be applicable to the case giving priority to either from among plural kinds of performance-manipulation-elements when the playing is made by the plural performance-manipulation-elements.

What is claimed is:

1. An electronic musical instrument with an automatic performance function, comprising:

manual performance means, provided with a plurality of performance manipulators to be performed by a player, for generating a manual performance musical tone having a tone color, in response to the player's performing;

automatic performance means for automatically generating automatic performance musical tones of a plurality of parts respectively corresponding to a plurality of tone colors; and control means responsive to generation of the manual performance musical tone, for stopping generation of an automatic performance musical tone, from among the automatic performance musical tones, of a part corresponding to the tone color of the manual performance musical tone generated by the manual performance means, and after a predetermined period, for proceeding with the generation of the automatic performance musical tone.

2. An electronic musical instrument with an automatic performance function according to claim 1, wherein said automatic performance means is an automatic rhythm performance means for generating rhythm performance tones and said tone colors are percussion tone colors.

3. An electronic musical instrument with an automatic musical function according to claim 1, wherein said control means includes measuring means for measuring said predetermined period for each part in response to the generation of the manual performance musical tone.

4. An electronic musical instrument with an automatic performance function according to claim 1, wherein said control means controls said stopping and proceeding of the generation of the automatic performance musical tones individually for each part.

5. An electronic musical instrument with an automatic performance function according to claim 1, further comprising mode selection means for selecting either a first mode to stop or a second mode not to stop the generation of the automatic performance musical tone responsive to the manual performance musical tone.

6. An electronic musical instrument with an automatic performance function according to claim 5, further comprising display means for displaying the selected one of the first and second modes.

7. An electronic musical instrument with an automatic performance function according to claim 1, wherein said predetermined period is measured in bars.

8. An electronic musical instrument with an automatic performance function according to claim 1, wherein said control means stops the generation of the automatic performance musical tone by lowering a tone volume thereof.

9. An electronic musical instrument with an automatic performance function according to claim 1, wherein the tone color of the automatic performance musical tone to be stopped is the same as the manual performance musical tone to be generated.

10. An electronic musical instrument with an automatic performance function according to claim 1, wherein the tone color of the automatic performance musical tone to be stopped is similar to that of the manual performance musical tone to be generated.

11. An electronic musical instrument with an automatic performance function, comprising:

a plurality of performance manipulators to be performed by a player;

memory means for storing a plurality of automatic performance data and storing, for each of the plurality of the automatic performance data, assignment data representing a plurality of tone colors to be respectively assigned to the plurality of performance manipulators;

selection means for selecting one of the plurality of the automatic performance data;

read means for reading one of the plurality of automatic performance data selected by the selection means and reading the assignment data corresponding to the automatic performance data selected by the selection means;

automatic performance means for automatically performing an automatic performance according to the automatic performance data read by the read means;

assignment means for assigning a tone color to each of the plurality of performance manipulators according to the assignment data read by the read means; and musical tone generation means for, in response to the player's performing, generating a musical tone having a tone color assigned to a performed performance manipulator.

12. An electronic musical instrument with an automatic performance function according to claim 11, said assignment data is specifying data specifying one of a plurality of tone color set data each consisting of a plurality of tone color data, and said assignment means previously stores the plurality of tone color set data and assigns the tone color to each of the plurality of performance manipulation elements according to the specifying data and the tone color set data.

13. An electronic musical instrument with an automatic performance function according to claim 11, said plurality of the performance manipulation elements are formed to percussion types, and said tone color is a percussion tone color.

14. An electronic musical instrument with an automatic performance function according to claim 11, said automatic performing is automatic rhythm performing.

15. An electronic musical instrument with an automatic performance function according to claim 11, wherein the instrument has a first mode for stopping the automatic performing responsive to the performance manipulation element and a second mode for not stopping the automatic performing responsive to the performance manipulation element, and said assignment means assigns the tone color to each of the performance manipulation elements when the mode is changed from the second mode to the first mode according to the assignment data.

16. An electronic musical instrument with an automatic performance function, comprising:

manual performance means, provided with a plurality of performance manipulators to be performed by a player, for generating a manual performance musical tone having a tone color in response to the player's performing;

automatic performance means for automatically generating automatic performance musical tones of a plurality of parts respectively corresponding to a plurality of tone colors; and control means responsive to generation of the manual performance musical tone, for lowering a tone volume of an automatic performance musical tone, from among the automatic performance musical tones, of a part corresponding to the tone color of the manual performance musical tone to be generated by the manual performance means, and after a predetermined period, for restoring the tone volume of the automatic performance musical tone.

* * * * *